United States Patent [19]

Eaby et al.

[11] 4,405,192

[45] Sep. 20, 1983

[54] HERMAPHRODITIC CONNECTOR

[75] Inventors: Daniel G. Eaby, Mt. Joy; John R. Shuey, Carlisle, both of Pa.

[73] Assignee: AMP Incorporated, Harrisburg, Pa.

[21] Appl. No.: 233,543

[22] Filed: Feb. 11, 1981

[51] Int. Cl.[3] ..... H01R 13/633

[52] U.S. Cl. ..... 339/91 R

[58] Field of Search ..... 339/91 R, 47 R, 47 C, 339/49 R

[56] References Cited

U.S. PATENT DOCUMENTS

| | | | |
|---|---|---|---|
| 3,467,942 | 9/1969 | Dell et al. | 339/49 R |
| 3,573,716 | 4/1971 | Garver . | |
| 3,926,497 | 12/1975 | Eigenbrode | 339/91 R |
| 3,989,343 | 11/1976 | Lucius et al. . | |
| 4,146,287 | 3/1979 | Jonsson . | |
| 4,153,326 | 5/1979 | Frantz et al. | 339/49 R |

FOREIGN PATENT DOCUMENTS

| | | | |
|---|---|---|---|
| 2373897 | 8/1978 | France | 339/47 R |

*Primary Examiner*—Mark Rosenbaum

*Attorney, Agent, or Firm*—Frederick W. Raring; Adrian J. LaRue

[57] ABSTRACT

Multi-contact electrical connector comprises an insulating housing having contact terminals therein. The housing has oppositely facing endwalls on each of which there is provided a latching means for latching the connector to a complementary connecting device. Each latching means comprises a latch arm which extends forwardly beyond the mating end of the connector and a latching ear which cooperates with a latch arm on the complementary connecting device. The latch arms on the two endwalls are located on one side of a medial reference plane and the latch ears on the other side of the reference plane. The reference plane extends normally on the endwalls of the housing and parallel to the sidewalls. When the connector is coupled to an identical connector or other complementary connecting device, each terminal in the connector is coupled with a terminal in the complementary connecting device which occupies the same position in the complementary device as the terminal in the connector. The complementary device may be identical to the connector.

3 Claims, 6 Drawing Figures

HERMAPHRODITIC CONNECTOR

FIELD OF THE INVENTION

This invention relates to electrical connectors of the type comprising an insulating housing having latching means thereon for coupling the connector to a complementary connecting device which may be an identical connector. The latching means on the connector is particularly intended for use in modular wiring systems.

BACKGROUND OF THE INVENTION

U.S. Pat. No. 4,153,326 (which is hereby incorporated by reference in its entirety) discloses and claims a wiring system in which hermaphroditic type electrical connectors are used to connect the ends of wires in a first cable to the ends of wires in a second cable. The connector shown in this patent is not only hermaphroditic but it also can be mated with an identical connector which is in opposed inverted relationship to the connector on the end of the first cable. This feature is important in connectors used for service wiring systems, for the reason that corresponding wires, for example, color coded wires, in the two cables will be connected to each other when two of the connectors are coupled to each other. The connector shown in U.S. Pat. No. 4,153,326 can also be coupled to other complementary connecting devices, such as tap connectors installed on a cable intermediate the ends thereof.

It would be desirable to provide a latching means on connectors of the general type shown in U.S. Pat. No. 4,153,326 to latch two connectors to each other upon coupling, thereby to prevent accidental de-coupling with a resulting interruption in electrical service. Integral latching means on multi-contact electrical connectors are widely known and are commonly used in the electrical industry. Presently available latching systems are not, however, suitable for connectors used in modular wiring systems for several reasons. For example, it is highly desirable that the connectors be hermaphroditic so that only one type of connector is required throughout a wiring system. Furthermore, it is not sufficient that the connectors be merely hermaphroditic; the connectors must also be such that corresponding wires in two cables be connected to each other when two connectors are coupled to each other. For example, the ground wire in the one cable must be connected to a ground wire in the second cable, and the connectors must be such that it is impossible to incorrectly connect the wires in two cables to each other.

Known types of connector latching systems are not entirely satisfactory for modular wiring applications for the additional reason that it is frequently necessary to couple and de-couple the connectors under awkward or unfavorable conditions, such as when the connectors are located in relatively inaccessible portions of a wiring installation. A satisfactory latching system for connectors used in service wiring systems must therefore be such that connectors can be coupled and de-coupled quickly and conveniently under such adverse conditions. Additionally, the latching means used should be positive and relatively foolproof so that wiring cables can be installed by a relatively unskilled technician and, after installation, will remain coupled under all normal expected circumstances.

The present invention is therefore directed to the achievement of an improved connector having improved latching means for use on cables used in modular wiring systems for buildings or the like.

A preferred form of electrical connector in accordance with the invention comprises an insulating housing of molded thermoplastic material having a mating end, a conductor entry end, oppositely facing sidewalls, and oppositely facing endwalls extending between the two ends. Latching means are provided on each of the endwalls, each latching means comprising a latch arm and a latching ear. The latch arms are disposed on one side of a medial reference plane which extends through the connector normally of the endwalls and substantially bisects the endwalls. The latching ears are on the other side of the reference plane so that two connectors in opposed inverted relationship can be coupled to each other. The resulting connector assembly, comprising the two coupled connectors, is thus held together by four latch arms, two latch arms on each side of the connector assembly. The latch arms are provided with conveniently located finger pieces that can be grasped by a technician who wishes to de-couple the two connectors under unfavorable or adverse circumstances, such as where the connectors are inconveniently located.

DETAILED DESCRIPTION OF THE PREFERRED EMBODIMENT

Figure 1:
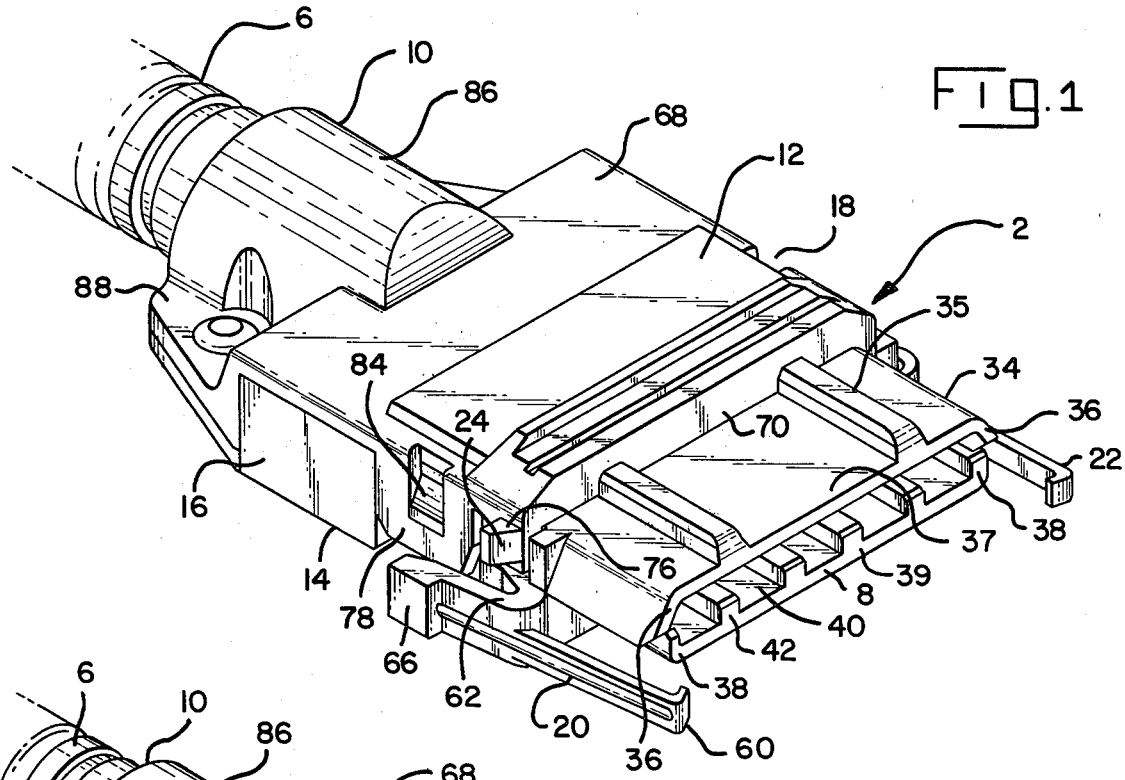
FIG. 1 is a perspective view of a preferred form of electrical connector in accordance with the invention.
Figure 2:
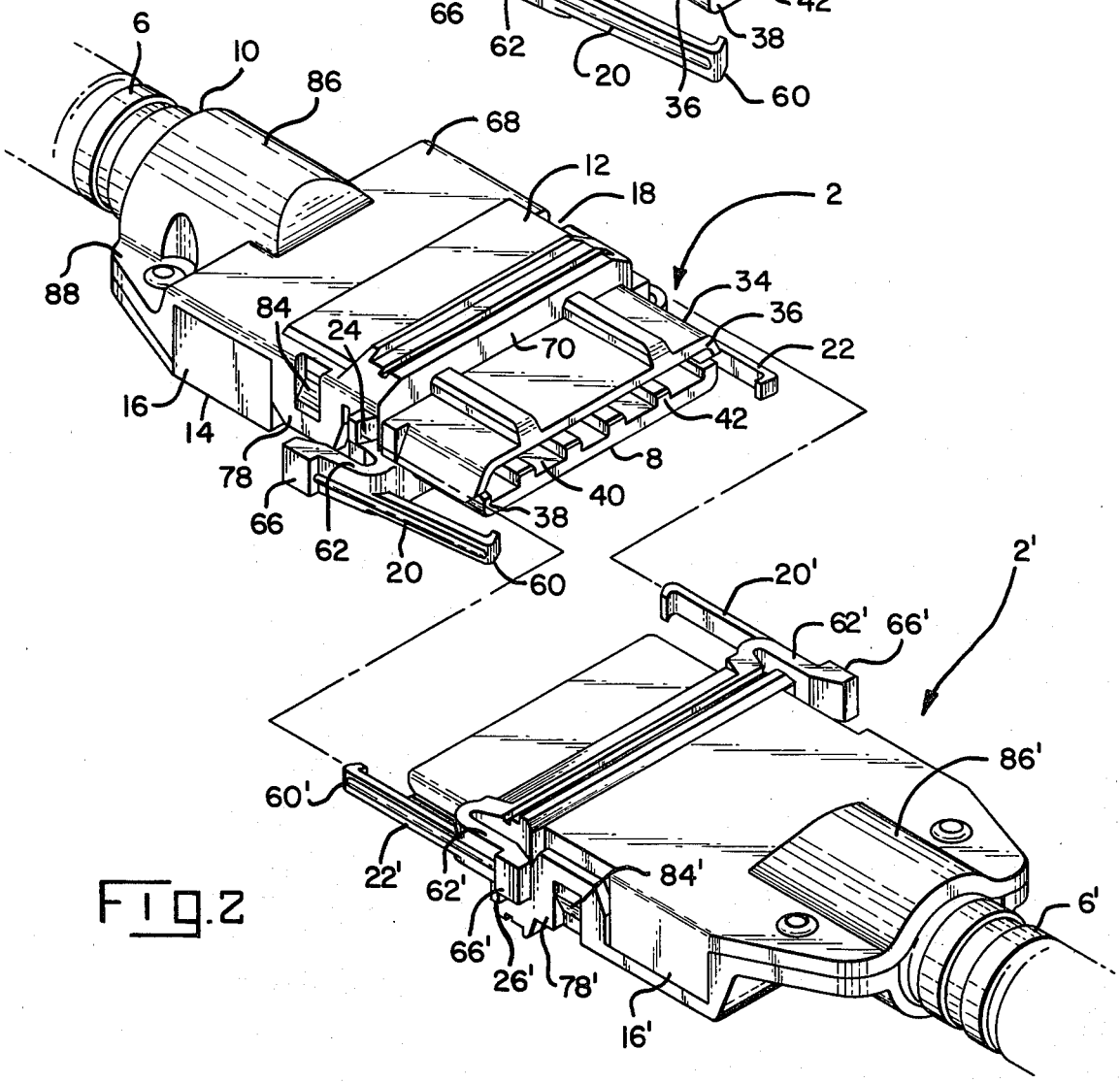
FIG. 2 is a perspective view showing two identical connectors in opposed inverted relationship to each other.
Figure 5:
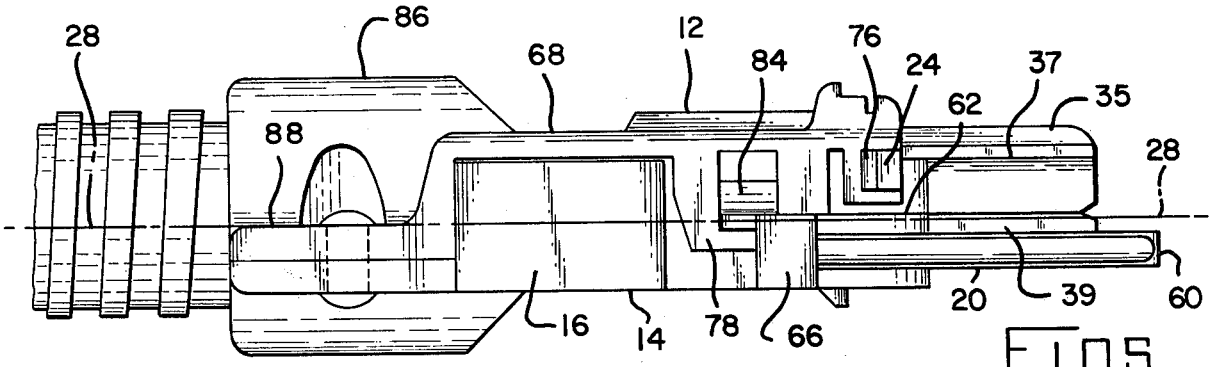
FIG. 5 is a side view looking in the direction of the arrow 6—6 of FIG. 4.
Figure 4:
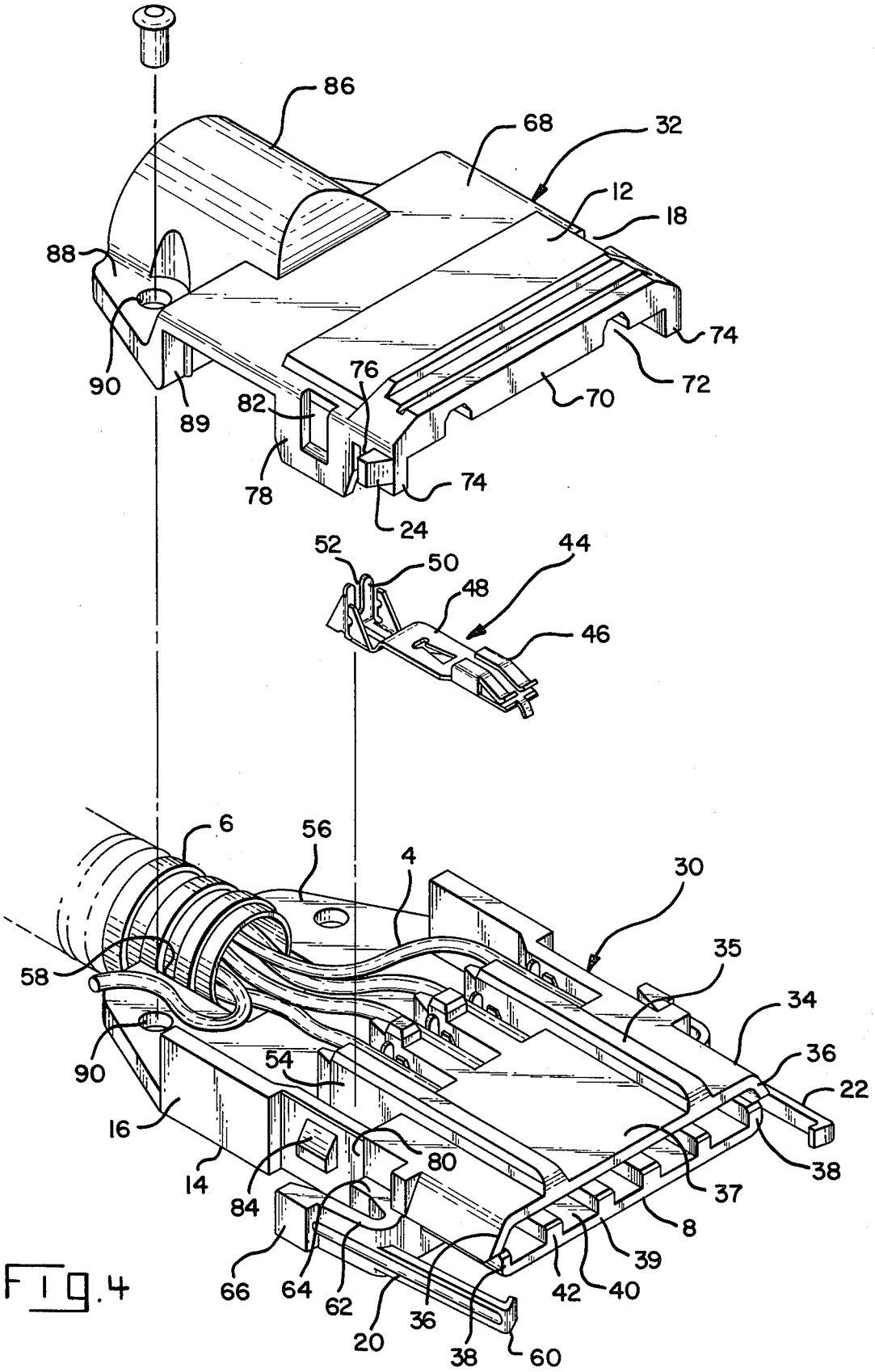
FIG. 4 is a view similar to FIG. 1 but showing the cover member exploded from the housing body and showing an individual terminal exploded from the housing body.

A connector 2 in accordance with the invention, FIG. 1, serves to connect individual insulated conductors 4, FIG. 4, in a first cable 6 to corresponding conductors in a second cable shown at 6'. The second cable extends to an identical connector 2' and the two connectors of the assembly are therefore hermaphroditic. The connector 2 comprises a housing having a mating end 8, a conductor entry end 10, upper and lower external sidewalls 12, 14, and oppositely facing endwalls 16, 18. Each endwall is provided with a latching means in the form of a latch arm and a latching ear, the endwall 16 having latch arms as shown at 20, and a latch ear as shown at 24. The endwall 18 has a latch arm 22 and a latching ear 26. As shown in FIG. 5, the latch arms 20, 22 are on one side of a medial plane 28 while the latch arms 24, 26 are on the other side of the plane 28. When it is desired to couple the connector 2 to the connector 2', the connector 2' is placed in an opposed inverted relationship to the connector 2, and the two connectors are moved relatively towards each other until the latch arms in each connector engage the latching ears of the other connector. As will be explained below, the fact that the connectors are in opposed inverted relationship (and not reversed end-to-end) results in a formation of electrical connections between corresponding conductors 4 and 4' in the two cables 6, 6'.

Turning now to FIG. 4, the housing comprises a housing body 30 and a housing cover shown at 32. The housing body has a forward end 34 which is enclosed and which has an upper wall 37 on which strengthening ribs 35 are provided. This forward portion has obliquely downwardly extending side flanges 36 which form part of the endwalls of the completed housing and upwardly extending side flanges 38, the flanges 38 being inwardly recessed with respect to the flanges 36. As explained in the above identified U.S. Pat. No. 4,153,326, the dimensions are such that the bottom wall 39 of the forward portion can be received under the top wall 37 of an identical connector, and the flanges 38 can be received between the flanges 36 of the top wall of the forward portion 34 of an identical connector.

A plurality of side-by-side terminal receiving cavities 40 extend inwardly from the mating end 8 of the body portion 30 and these cavities open onto the top wall at their rearward ends as shown at 54. Each cavity contains a terminal 44, each terminal having a forward contact portion 46, a flat intermediate web portion 48, and a wire connecting portion 50 at its rearward end. The wire connecting portion has a wire receiving slot 52 so that the wires 4 can be connected to the individual terminals by merely moving the wires laterally of their axes into the rearward portions 54 of the cavities and into the slots 52 of the terminals. The terminals are separated from each other in the housing by barriers 42 which are integral with the bottom wall of the forward portion of the housing.

The housing body 30 further comprises an apron portion 56 which is an extension of the bottom wall and which extends beyond the endwalls 16, 18. This apron has a semi-cylindrical depression 58 therein for reception of the end portion of the cable 6 as shown in FIG. 4.

The latch arms are identical to each other so that a description of one will suffice for both. Each latch arm 20, 22 has an intermediate portion which extends beside and is spaced from its associated endwall 16, 28. The forward or free end 60 of each latch arm is located beyond the mating end of the housing and is inwardly turned as shown for cooperation with a shoulder 76 of one of the latch ears. The rearward end of each latch arm is integral with a generally U-shaped spring member 62, one end of which 64 is in turn integral with the endwall of the housing. The other end 66 of the spring member is provided with a flat outwardly facing surface so that both latch arms of a connector can be swung outwardly from their positions as shown in FIG. 4, by placing the thumb and forefinger on the surfaces 66 and pressing these surfaces towards the endwalls of the housing.

The cover member 32 of the housing has a top wall 68 from which a skirt 70 depends at its forward end. This skirt is notched, as shown at 72, to provide clearance for the ribs 35 on the top wall of the forward enclosed portion 34 of the housing body. The latching ears 24, 26 extend from flanges 74 which are provided on the sides of the top wall 68 adjacent to the skirt 70. These ears, as previously mentioned, have rearwardly facing shoulder surfaces 76 and are engaged by the inwardly turned ends 60 of the latch arm. The cover member 32 is held on the housing body 30 by means of latching flanges 78 which depend from the side edges of the top wall 68 immediately behind the ears 24, 26. These flanges 78 are received in recesses 80 in the endwalls 16, 18, and ears 84 are provided in these recesses for cooperation with openings 82 in the flanges 78. It will be apparent when the cover member 32 is moved downwardly from the position shown in FIG. 4, the flanges 78 will be flexed outwardly as they move over the ears 84 until the ears fully enter the openings 82 in the flanges.

A semi-cylindrical cable clamping portion 86 extends from the rearward edge of the top wall 68 and is supported by integral gusset sections 88 which are also integral with a depending flange 89 at the rearward end of the top wall 68. The cover section is held on the body 30 by means of suitable fasteners which are passed through aligned openings 90 in the gusset sections 88 and the rearwardly extending apron 56 of the housing body.

Connector housings in accordance with the invention can be produced from any suitable polymeric material, preferably a thermoplastic. A suitable nylon composition can be used, if desired, or a polycarbonate can be used if the connector is to be subjected to use under adverse conditions. The terminals may be of any suitable conductive metal, such as brass or phosphor bronze.

Figure 6:
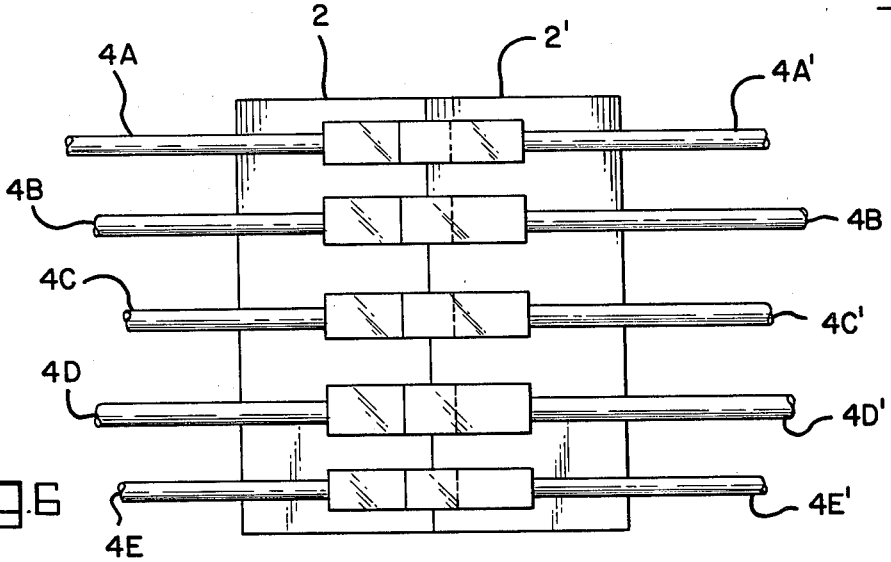
FIG. 6 is a schematic view illustrating the electrical connections between the conductors of two cables.

FIG. 6 illustrates a feature of the invention which is of great importance to connectors used for wiring buildings. Since two connectors 2,2' can be mated with each other only when they are in opposed inverted relationship, corresponding conductors in the two cables will be connected to each other when the connectors are coupled. As shown in FIG. 6 then, conductor 4A in connector 2 will be connected to conductor 4A' in connector 2', and the other conductors will similarly be connected to their counterparts. This feature is of great importance in house wiring, for example, for the reason that one or more of the conductors 4 may be ground conductors and these must be connected to their counterparts in the connector on the end of the next adjacent cable. The remaining conductors in the cable 6 must also be positively identified and all the wiring circuits of the building must be connected to their counterparts throughout the system.

Figure 3:
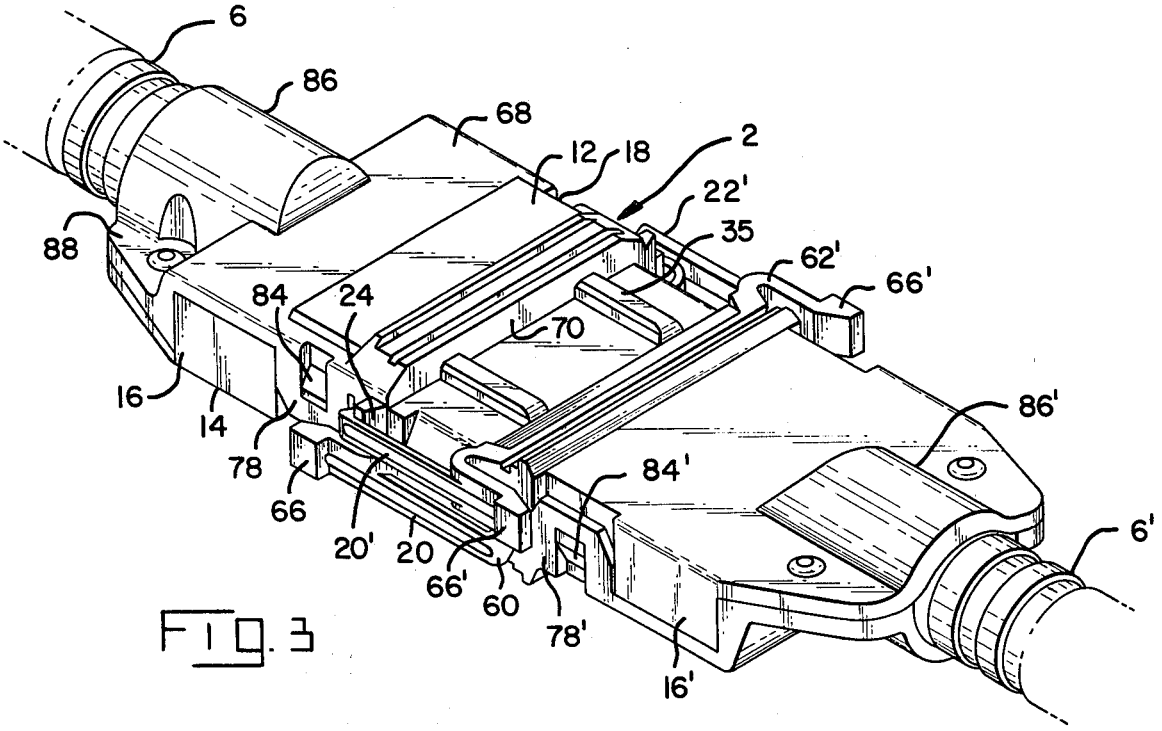
FIG. 3 is a perspective view showing two connectors in accordance with the invention coupled to each other.

As will be apparent from an inspection of FIG. 3, two connectors 2, 2' coupled to each other will be held securely in their mated condition by virtue of the fact that four latch arms are provided in the mated pair of connectors. Accidental or careless disengagement of the connectors is, therefore, highly unlikely, and the two conductors can be de-coupled only by a deliberate action on the part of a technician. De-coupling can, however, be readily carried out when it is desired to separate the two connectors. The bearing surface 66 of the latch arms of each connector is located rearwardly of the latching ears 24, 26 of each connector. When the technician, using two hands, presses on all of the bearing surfaces, his hands will be located such that they will not interfere with the movement of the free ends of the latch arms from the latching ears with which they are engaged.

What is claimed is:

1. An electrical connector for matable engagement with a complementary electrical connector, comprising:

an insulating housing means having terminal passageways in which electrical terminal means are to be disposed for terminating electrical conductors, said housing means having sidewalls and a mating end for matable engagement with a like matable end of a complementary electrical connector;

latch means including latch arm means and engaging means;

spring means integrally connecting said latch means to side sidewalls of said housing means so that said latch arm means extend toward a front end of said housing means alongside the mating end while said engaging means extend toward a back end of said housing means, said latch means being on one side of a medial plane which includes a longitudinal axis of said housing means;

latching ear means on said sidewalls above said spring means of said latch means and being on the other side of said medial plane;

said housing means having a body member and a cover member, said latch means being on one of said members, said latching ear means being on the other of said members;

said latch arm means adapted to latchably latch onto said latching ear means when the matable ends of complementary electrical connectors are matably engaged, said engaging means when engaged and moved inwardly toward said sidewalls moving said latch arm means free of said latching ear means to enable the matable ends of the complementary electrical connectors to be disconnected.

2. An electrical connector as set forth in claim 1 wherein said latch means being on said body member and said latching ear means being on said cover member and spaced rearwardly of said spring means.

3. An electrical connector as set forth in claim 1 wherein latching flanges on said cover member latchably engage latching ears on said body member thereby latching said members together.

* * * * *